United States Patent [19]

Whitworth et al.

[11] 3,960,621

[45] June 1, 1976

[54] PROPELLENTS

[75] Inventors: Edward Whitworth, West Kilbride, Scotland; Stuart Gordon, Kidderminster, England; Stephen Harry Hayes, West Kilbride, Scotland

[73] Assignee: Imperial Chemical Industries Limited, London, England

[22] Filed: June 12, 1959

[21] Appl. No.: 820,058

Related U.S. Application Data

[63] Continuation-in-part of Ser. No. 645,642, March 12, 1957, abandoned.

[30] Foreign Application Priority Data

Nov. 5, 1958 United Kingdom ..... 35605/58

[52] U.S. Cl. ..... 149/65; 149/92; 149/97; 149/98; 149/108.2

[51] Int. Cl.[2] ..... C06B 31/26; C06B 29/20; C06B 29/08; C06B 25/34

[58] Field of Search ..... 52/0.5; 149/65, 79, 149/83, 98, 92, 108.2, 19.1, 19.2

[56] References Cited

UNITED STATES PATENTS

| | | | |
|---|---|---|---|
| 2,221,391 | 11/1940 | Whitworth | 149/65 |
| 2,362,618 | 11/1944 | Winning | 149/65 |
| 2,577,298 | 12/1951 | Ball | 149/65 |
| 2,799,566 | 7/1957 | Cook | 149/65 |
| 2,907,073 | 10/1959 | Ball | 149/65 |

OTHER PUBLICATIONS

Warren, "Rocket Propellants," Reinhold Publishing Co., New York, (1958), pp. 58–60.

Military Explosives, Depts. of the Army and Air Force, TM9–1910 and TO 11A–1–34, Apr., 1955, p. 259.

*Primary Examiner*—Benjamin R. Padgett
*Assistant Examiner*—Donald P. Walsh
*Attorney, Agent, or Firm*—Cushman, Darby & Cushman

EXEMPLARY CLAIM

1. A process for the production of a cast propellent which consists in blending a colloided nitrocellulose smokeless powder composition containing a platonisation agent selected from the group consisting of lead stearate, lead citrate, lead salicylate, lead 2:4 dihydroxy-benzoate, lead sulphite, lead oxide, copper oxalate, copper salicylate, copper 2:4 dihydroxy-benzoate and cupric oxide, with colloided nitrocellulose smokeless powder composition containing a secondary flash suppressing potassium salt in the proportion by weight of at least three parts of the first mentioned nitrocellulose composition, adding to the blended nitrocellulose compositions a casting liquid consisting essentially of nitroglycerine in an amount sufficient to fill the interstices in the blended nitrocellulose compositions, and heating the resulting mixture.

5 Claims, No Drawings

PROPELLENTS

This application is a continuation-in-part of our U.S. Ser. No. 645,642, filed Mar. 12, 1957, now abandoned.

This invention is concerned with new and improved propellents and more particularly with propellents that are particularly suitable for use as rocket charges.

Propellent charges commonly used for rocket motors are of the kind known as cast double base propellents. These are produced by inserting a casting powder consisting of a granular single base nitrocellulose composition, or if desired a double base nitrocellulose composition containing up to about 35% by weight nitroglycerine, in a mould where absorbed gases are removed from the surface of the powder by evacuation, introducing a casting liquid consisting essentially of nitroglycerine into the mould, preferably under pressure, for example of the order of 50 lb./sq.in., until the interstices between the granules of the casting powder are filled and heating the contents of the mould in an oven for example at 140°F. for a period which may be of the order of 3 to 4 days, slight gas pressure being maintained on the mould during heating if desired. The mould may, if desired, be lined with a suitable material such as cellulose acetate which becomes bonded to the propellent during heating and provides a combustion inhibiting coating. These propellents normally have incorporated therein a lead salt as a platonisation agent, i.e. an agent that causes the rate of burning either to remain substantially constant over a very considerable pressure range or to vary only very slightly as the pressure rises in said pressure range.

It is often desirable that the gases generated by the propellent used for rocket motors which are not completely oxidised should not ignite outside the nozzle when they come into contact with the atmosphere, in other words the propellent should be free from secondary flash, so that for example radio control can be maintained. The presence of secondary flash from the exhaust gases causes modulation and may cause considerable attentuation or even suppression of radar signals transmitted to the rocket. In the more conventional double base propellents the elimination of secondary flash can be accomplished by the incorporation of potassium salts. Attempts to achieve freedom from secondary flash in platonised cast double base propellents by this method, however, have been unsuccessful since the incorporation of a potassium salt causes the platonisation agent to cease to be effective.

It is an object of the present invention substantially to eliminate secondary flash in order to remove or reduce the disadvantages hereinbefore indicated.

The invention, which is a modification of the invention described in our co-pending U.K. Application No. 12278/56, resides broadly in incorporating a platonisation agent and a potassium salt in separate portions of granular nitrocellulose compositions, which may be either a single or a double base composition, thereafter blending the said separate portions of granular nitrocellulose composition together, introducing a casting liquid in which nitroglycerine is the predominant constituent to the blended nitrocellulose composition in sufficient amount to fill the interstices in the blend and then heating the resulting composition at the required temperature and for the appropriate time to obtain the required consistency. The ratio of the portion of granular nitrocellulose containing a platonisation agent to that containing a potassium salt is at least 75% to 25% by weight. The lesser portion of granular nitrocellulose composition contains an amount of potassium salt calculated to provide about from 1 – 7% by weight of potassium salt in the final product and it will be seen that the smaller the ratio of the potassium salt containing portion to that containing the platonisation agent in the nitrocellulose blend the larger will be the proportion of potassium salt required in that portion prior to blending.

Where the granular nitrocellulose composition containing a platonisation agent is a double base composition it preferably contains not more than 35% by weight of nitroglycerine.

If desired, for example for convenience in manufacture, the portion of granular nitrocellulose composition containing a potassium salt also may contain a platonisation agent. Platonisation agents are known and examples of suitable platonisation agents include a range of organic lead compounds such as lead stearate, lead citrate, lead salicylate, or lead 2:4 di-hydroxy benzoate, and inorganic compounds of lead such as lead sulphite and the oxides of lead. Lead sulphate has been found to be an exception in that it is not a satisfactory platonisation agent. Copper compounds have also been found to be capable of employment as platonisation agents and suitable copper compounds include cupric oxide and the salicylate, oxalate and 2:4 di-hydroxy benzoate of copper.

The potassium salt may be any one of those used in conventional propellents for the suppression of secondary flash. Thus suitable salts include potassium sulphate, potassium nitrate, potassium aluminium fluoride and potassium hydrogen tartrate. As previously stated the amount of potassium salt present in the lesser proportion of granular nitrocellulose composition before blending will be governed by the ratio of the two amounts of nitrocellulose composition being blended and it may be present in amounts up to about 70% before blending but the preferred amount is between 10% and 30%.

After the nitrocellulose compositions containing respectively a platonisation agent and a potassium salt have been blended, the nitroglycerine casting liquid is added in excess in any suitable manner. Absorption of the casting liquid causes the blended nitrocellulose compositions to soften and swell until a point is reached when no further liquid is accepted by the nitrocellulose composition. The proportion of blended nitrocellulose powder to nitroglycerine containing casting liquid is influenced by the packing density of the powder blend and, in a preferred blend, the proportion is of the order of two parts of blended nitrocellulose to one part of casting liquid by weight. In the presence of excess casting liquid the ends of the charge may be rather soft and to obtain uniform charges it may be necessary to cut off their ends.

The invention is illustrated by the following examples in which all parts are by weight unless otherwise stated.

Example 1

Two granular nitrocellulose compositions were made in a conventional manner having the following composition by weight:

| | A | B |
|---|---|---|
| Soluble nitrocellulose(12.6% nitrocellulose content) | 80 | 51 |

-continued

| | A | B |
|---|---|---|
| Nitroglycerine | 2.7 | 18 |
| Sucrose octa-acetate | 12.3 | — |
| Lead stearate | 5.0 | — |
| 2-nitrodiphenylamine | — | 1 |
| Ethyl centralite | 0.25 | — |
| Potassium nitrate | — | 30 |

19 parts of Composition A and 1 part of Composition B were blended together and the blend put in a mould where a casting liquid consisting of 76 parts nitroglycerine, 23 parts triacetin and 1 part 2-nitrodiphenylamine was added in sufficient amount to fill the interstices, about 10 parts being required. The contents of the mould were then heated for 72 hours at 75°C. The product so obtained had the following composition:

| | Parts |
|---|---|
| Nitrocellulose | 49.6 |
| Nitroglycerine | 30.2 |
| Triacetin | 8.4 |
| Sucrose octa-acetate | 7.4 |
| Lead stearate | 3.0 |
| 2-nitrodiphenylamine | 0.4 |
| Ethyl centralite | 0.15 |
| Potassium nitrate | 1.0 |

The calorimetric value of the composition was 765 cal./g. and the rate of burning 0.165 in./sec. at 500 lb./sq.in. and 0.16 in./sec. at 850 lb./sq.in., being approximately constant between 500 and 850 lb/sq.in. Secondary flashing was entirely suppressed.

Example 2

A product having the composition;

| | Parts |
|---|---|
| Nitrocellulose | 49.8 |
| Nitroglycerine | 29.4 |
| Triacetin | 8.3 |
| Sucrose octa-acetate | 7.5 |
| Lead stearate | 3.0 |
| 2-nitrodiphenylamine | 0.4 |
| Ethyl centralite | 0.15 |
| Potassium nitrate | 1.6 |

was made in a manner similar to that of Example 1 by blending 19 parts of Composition A with 1 part of a granular nitrocellulose Composition C and using the same casting liquid.

Granular nitrocellulose Composition C was prepared in a conventional manner to have the following composition:

| | Parts |
|---|---|
| Nitrocellulose | 37 |
| Nitroglycerine | 12 |
| 2-nitrodiphenylamine | 1 |
| Potassium nitrate | 50 |

The aforesaid product had a calorimetric value of 766 cal./g. and a burning rate of 0.165 in./sec. at 450 lb./sq.in. and 0.150 in./sec. at 850 lb./sq.in. and was free from secondary flash on firing.

For purposes of comparison a composition not according to the invention was made in a similar manner from the same casting liquid and a casting powder having the composition:

| | Parts |
|---|---|
| Nitrocellulose | 77.5 |
| Nitroglycerine | 2.6 |
| Sucrose octa-acetate | 11.9 |
| Lead stearate | 4.7 |
| Ethyl centralite | 0.25 |
| Potassium nitrate | 3.3 |

The product so obtained had the composition:-

| | Parts |
|---|---|
| Nitrocellulose | 49.2 |
| Nitroglycerine | 29.4 |
| Triacetin | 8.4 |
| Sucrose octa-acetate | 7.5 |
| Lead stearate | 3.0 |
| 2-nitrodiphenylamine | 0.4 |
| Ethyl centralite | 0.16 |
| Potassium nitrate | 2.1 |

The rate of burning of this composition was 0.12 in./sec. at 450 lb./sq.in. and 0.18 in./sec. at 850 lb./sq.in. Thus the incorporation of the potassium salt homogeneously throughout the composition caused the loss of the platonisation effect of the lead salt.

Example 3

A composition similar to that of Example 1 in which the potassium nitrate was replaced by potassium sulphate was made up in a similar manner. The product so obtained had a calorimetric value of 760 cal./g. and a burning speed of 0.175 in./sec. at 500 lb./sq.in. and 0.17 in./sec. at 900 lb./sq.in.

For comparison a composition not according to the invention was made using the same casting liquid and a casting powder of the following composition:

| | Parts |
|---|---|
| Nitrocellulose | 80 |
| Nitroglycerine | 2.7 |
| Lead Stearate | 5.0 |
| Ethyl centralite | 0.25 |
| Sucrose octa-acetate | 12.3 |

The product obtained had the following composition:-

| | Parts |
|---|---|
| Nitrocellulose | 51.7 |
| Nitroglycerine | 28.7 |
| Triacetin | 8.1 |
| Sucrose octa-acetate | 7.9 |
| Lead stearate | 3.2 |
| 2-nitrodiphenylamine | 0.4 |
| Ethyl centralite | 0.16 |

This product had a burning rate of 0.17 in./sec. at 500 lb./sq.in. and 0.16 in./sec. at 850 lbs./sq.in. and was thus platonised but due to the absence of a potassium salt when used as a propellant for a rocket considerable secondary flash was exhibited in the exhaust and radar signals sent to the rocket were almost completely suppressed.

Example 4

A product similar to that of Example 2 in which the potassium nitrate was replaced by potassium sulphate was made in a similar manner. The product so obtained had a calorimetric value of 746 cal./g. and a burning rate of 0.16 in./sec. at 550 lb./sq.in. and 0.16 in./sec. at 850 lb./sq.in. and was free from secondary flash on firing.

Example 5

A product was prepared in a similar manner to Example 1 having the composition:-

| | Parts |
|---|---|
| Nitrocellulose | 50.6 |
| Nitroglycerine | 28.7 |
| Triacetin | 8.0 |
| Sucrose octa-acetate | 7.6 |
| Lead stearate | 3.1 |
| 2-nitrodiphenylamine | 0.4 |
| Ethyl centralite | 0.15 |
| Potassium aluminium fluoride | 1.6 |

The calorimetric value of this material was 738 cal./g. and the burning speed of 0.165 in./sec. at 500 lb./sq.in. and 0.15 in./sec. at 850 lb./sq.in. and was free from secondary flash on firing.

Example 6

A product was obtained containing 1% potassium sulphate from a casting powder consisting of a 100:6.75 blend of a powder containing no potassium salt (granular nitrocellulose Composition A in Example 1) and one containing 30% potassium sulphate (granular nitrocellulose Composition D) and the same casting liquid as in Example 1 when proceeding as in Example 1.

Granular nitrocellulose Composition D had the following composition:-

| | Parts |
|---|---|
| Nitrocellulose | 80.0 |
| Nitroglycerine | 2.7 |
| Sucrose octa-acetate | 12.3 |
| Potassium sulphate | 30.0 |
| Ethyl centralite | 1.7 |

No secondary flash was observed from said product when fired in a rocket and transmission of radar signal was of an acceptable level. When a hydrogen torch (oxygen/hydrogen) operating at 30 lb./sq.in. was applied the gases issuing from the nozzle re-ignited and full secondary flashing was maintained until removal of the torch.

When the same two granular nitrocellulose compositions namely A and D were mixed together in the proportions 100:13.5 and the resulting blend treated with the same casting liquid as in Example 1 and the same procedure was adopted as in Example 1 a product was obtained containing 2% potassium sulphate. On firing secondary flashing was entirely suppressed and application of two hydrogen torches, each operating at 70 lb./sq.in failed to ignite the gaseous efflux. Transmission of radar signal was very satisfactory.

Example 7

A casting powder of the following compositions (all parts being by weight):

| | Parts |
|---|---|
| Nitrocellulose | 75 |
| Nitroglycerine | 17.0 |
| Lead 2:4-dihydroxy benzoate | 3.0 |
| Lead salicylate | 3.0 |
| 2-nitrodiphenylamine | 2.0 |
| Carbon black | 0.3 |

was cast with a liquid consisting of niroglycerine 75%, triacetin 24% and 2-nitrodiphenylamine 1%, giving a product of the following composition:-

| | |
|---|---|
| Nitrocellulose | 48.5 |
| Nitroglycerine | 37.6 |
| Triacetin | 8.5 |
| 2-nitrodiphenylamine | 1.6 |
| Lead 2:4-dihydroxy benzoate | 1.9 |
| Lead salicylate | 1.9 |
| Carbon black | 0.2 |

This had a burning rate of 0.795 in./sec. at 1440 p.s.i./sq.in. and was satisfactory from that point of view. When used as a propellant for a rocket, however, considerable secondary flash was exhibited.

A product similar to that of Example 1 was obtained when a casting powder was prepared by blending the above powder with one having the following composition in such a proportion that the resultant powder contained 3% of potassium sulphate:-

| | Parts |
|---|---|
| Nitrocellulose | 63.1 |
| Nitroglycerine | 2.1 |
| Sucrose octa-acetate | 9.7 |
| Ethyl centralite | 1.35 |
| Potassium sulphate | 22.75 |

The resultant casting powder was cast with the same liquid as above and gave a final product, the composition of which was as follows:-

| | |
|---|---|
| Nitrocellulose | 48.9 |
| Nitroglycerine | 35.0 |
| Lead 2:4-dihydroxy benzoate | 1.64 |
| Lead salicylate | 1.64 |
| 2-nitrodiphenylamine | 1.45 |
| Carbon black | 0.07 |
| Sucrose octa-acetate | 0.80 |
| Ethyl centralite | 0.50 |
| Triacetin | 8.0 |
| Potassium sulphate | 2.0 |

The ballistics obtained were similar to those of the non-sulphate containing powder but without any secondary flash.

Example 8

Four lots of casting powder were made in the conventional manner with the following composition by weight:-

| | (1) | (2) | (3) | (4) |
|---|---|---|---|---|
| Pyro nitrocellulose | 60.0 | 64.0 | 64.0 | 64.0 |
| Nitroglycerine | 33.0 | 35.0 | 35.0 | 35.0 |
| Lead 2:4-dihydroxy benzoate | 3.0 | — | — | — |
| Lead salicylate | 3.0 | — | — | — |
| 2-nitrodiphenylamine | 1.0 | 1.0 | 1.0 | 1.0 |
| Carbon black | 0.3 | 0.3 | 0.3 | 0.3 |
| Potassium sulphate | — | 30.0 | 50.0 | 100.0 |

The non-sulphate containing powder was cast with a liquid consisting of nitroglycerine triacetin and 2-nitrodiphenylamine in the proportion 80/19/1 parts by weight. The resultant charge had the following composition:-

| | Parts |
|---|---|
| Nitrocellulose | 40.0 |
| Nitroglycerine | 48.5 |
| 2-nitrodiphenylamine | 1.0 |
| Lead 2:4-dihydroxy benzoate | 2.0 |
| Lead salicylate | 2.0 |
| Carbon black | 0.2 |
| Triacetin | 6.3 |

The propellant gave satisfactory ballistics but large secondary flashes.

Casting powder (1) was then blended with each of the three remaining powders in such a ratio as to give a powder containing 4.5% potassium sulphate. The resulting powders were then cast with the same liquid as the non-sulphate containing powder to give a propellant of the following nominal composition:-

| | | | |
|---|---|---|---|
| Nitrocellulose | 38.2 | 38.6 | 38.1 |
| Nitroglycerine | 48.0 | 47.2 | 47.6 |
| 2-nitrodiphenylamine | 1.0 | 1.0 | 1.0 |
| Lead 2:4-dihydroxy benzoate | 1.6 | 1.8 | 1.85 |
| Lead salicylate | 1.6 | 1.8 | 1.85 |
| Carbon black | 0.2 | 0.2 | 0.2 |
| Triacetin | 6.4 | 6.4 | 6.4 |
| Potassium sulphate | 3.0 | 3.0 | 3.0 |
| | 100.0 | 100.0 | 100.0 |

The resulting propellants had satisfactory ballistic properties and greatly reduced secondary flash. No. secondary flash was observed from said product when fired in a rocket and transmission of radar signals was of an acceptable level. When a hydrogen torch (oxygen/hydrogen) operating at 30 lb./sq.in. was applied the gases issuing from the nozzle re-ignited and full secondary flashing was maintained until removal of the torch.

What we claim is:

1. A process for the production of a cast propellent which consists in blending a colloided nitrocellulose smokeless powder composition containing a platonisation agent selected from the group consisting of lead stearate, lead citrate, lead salicylate, lead 2:4 dihydroxybenzoate, lead sulphite, lead oxide, copper oxalate, copper salicylate, copper 2:4 dihydroxy-benzoate and cupric oxide, with a colloided nitrocellulose smokeless powder composition containing a secondary flash suppressing potassium salt in the proportion by weight of at least three parts of the first mentioned nitrocellulose composition to each one part of the second mentioned nitrocellulose composition, adding to the blended nitrocellulose compositions a casting liquid consisting essentially of nitroglycerine in an amount sufficient to fill the interstices in the blended nitrocellulose compositions, and heating the resulting mixture.

2. A process for the production of a cast propellant according to claim 1 wherein the potassium salt is present in the lesser amount of nitrocellulose compositions in an amount sufficient to provide from 1 to 7 percent by weight of potassium salt in the finally blended propellant composition.

3. A process for the production of a cast propellant according to claim 1 wherein the amount of nitroglycerine added in the casting liquid does not exceed 35 percent by weight of the propellent composition.

4. A process for the production of a cast propellent according to claim 1 in which the potassium salt is selected from the group consisting of the sulphate, nitrate, aluminum fluoride and hydrogen tartrate of potassium.

5. A process for the production of cast propellents as set forth in claim 1 in which said colloided nitrocellulose smokeless powder compositions contain nitrocellulose and nitroglycerine.

* * * * *